US011011363B2

(12) United States Patent
Hart et al.

(10) Patent No.: US 11,011,363 B2
(45) Date of Patent: May 18, 2021

(54) ENCLOSURE FOR AMBIENT IONISATION ION SOURCE

(71) Applicant: MICROMASS UK LIMITED, Wilmslow (GB)

(72) Inventors: Philippa J. Hart, Broughton (GB); Mark W. Towers, Stockport (GB); Paul R. Murray, Manchester (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 16/301,143

(22) PCT Filed: May 15, 2017

(86) PCT No.: PCT/GB2017/051345
§ 371 (c)(1),
(2) Date: Nov. 13, 2018

(87) PCT Pub. No.: WO2017/194972
PCT Pub. Date: Nov. 16, 2017

(65) Prior Publication Data

US 2019/0295833 A1 Sep. 26, 2019

(30) Foreign Application Priority Data

May 13, 2016 (GB) ..... 1608401

(51) Int. Cl.
*H01J 49/16* (2006.01)
*H01J 9/04* (2006.01)
(Continued)

(52) U.S. Cl.
CPC ..... *H01J 49/165* (2013.01); *H01J 49/0404* (2013.01); *H01J 49/10* (2013.01); *H01J 49/14* (2013.01)

(58) Field of Classification Search
None
See application file for complete search history.

(56) References Cited

U.S. PATENT DOCUMENTS 5,742,050 A 4/1998 Amirav et al.
7,847,244 B2 12/2010 Venter et al.
(Continued)

FOREIGN PATENT DOCUMENTS

CN 101520432 A 9/2009
CN 202196744 U 4/2012
(Continued)

OTHER PUBLICATIONS

International Search Report and Written Opinion for International Application No. PCT/GB2017/051345, dated Aug. 2, 2017, 14 pages.
(Continued)

*Primary Examiner* — James Choi
(74) *Attorney, Agent, or Firm* — Kacvinsky Daisak Bluni PLLC

(57) ABSTRACT

An ambient ionisation ion source is disclosed that comprises a first device arranged and adapted to generate analyte ions from a target and an enclosure surrounding the first device. The enclosure includes one or more gas inlets and one or more gas outlets. The ambient ionisation ion source also comprises a second device arranged and adapted to supply the enclosure with a first gas via the one or more gas inlets such that the enclosure is maintained, in use, at a pressure greater than atmospheric pressure.

13 Claims, 3 Drawing Sheets

(51) Int. Cl.

| | |
|---|---|
| ***H01J 49/04*** | (2006.01) |
| ***H01J 49/14*** | (2006.01) |
| ***H01J 49/10*** | (2006.01) |

(56) References Cited

U.S. PATENT DOCUMENTS

| | | | | |
|---|---|---|---|---|
| 2003/0160167 | A1 | 8/2003 | Truche et al. | |
| 2004/0217281 | A1* | 11/2004 | Bai | H01J 49/164 250/288 |
| 2005/0056776 | A1 | 3/2005 | Willoughby et al. | |
| 2005/0269518 | A1 | 12/2005 | Bajic et al. | |
| 2008/0296485 | A1 | 12/2008 | Benter et al. | |
| 2009/0294660 | A1 | 12/2009 | Whitehouse et al. | |
| 2010/0078550 | A1* | 4/2010 | Wiseman | G01N 1/405 250/282 |
| 2010/0320374 | A1* | 12/2010 | Jarrell | H01J 49/067 250/282 |
| 2011/0049352 | A1* | 3/2011 | Ding | H01J 49/0463 250/282 |
| 2011/0220784 | A1 | 9/2011 | Roach et al. | |

FOREIGN PATENT DOCUMENTS

| | | | |
|---|---|---|---|
| CN | 103797559 | A | 5/2014 |
| EP | 3455872 | A1 | 3/2019 |
| WO | 2017194972 | A1 | 11/2017 |

OTHER PUBLICATIONS

Search Report for GB Application No. GB1608401.4, dated Sep. 29, 2016, 3 pages.

Communication pursuant to Article 94(3) EPC for Application No. 17724425.8, dated Sep. 30, 2020, 6 pages.

Examination Report under Section 18(3) for Application No. GB1608401.4, dated Jan. 19, 2021, 5 pages.

* cited by examiner

ENCLOSURE FOR AMBIENT IONISATION ION SOURCE

CROSS-REFERENCE TO RELATED APPLICATIONS

This application is a national phase filing claiming the benefit of and priority to International Patent Application No. PCT/GB2017/051345, filed on May 15, 2017, which claims priority from and the benefit of United Kingdom patent application No. 1608401.4 filed on May 13, 2016. The entire contents of these applications are incorporated herein by reference.

FIELD OF THE INVENTION

The present invention relates generally to mass spectrometers and in particular to methods of and apparatus for ambient ionisation mass spectrometry such as desorption electrospray ionisation ("DESI") mass spectrometry.

BACKGROUND

A number of different ambient ionisation ion sources are known. Ambient ionisation sources are characterised by the ability to generate analyte ions under ambient conditions (i.e. as opposed to under vacuum).

Desorption electrospray ionisation ("DESI") is an ambient ionisation technique that allows direct and fast analysis of surfaces without the explicit need for prior sample preparation. A spray of (primary) electrically charged droplets is sprayed onto a surface, and subsequent ejected (secondary) droplets carrying desorbed analyte ions are directed toward an atmospheric pressure interface of a mass and/or ion mobility spectrometer or analyser via a transfer capillary.

The ionisation process in many ambient ionisation techniques, including desorption electrospray ionisation ("DESI"), occurs in the ambient atmosphere. Accordingly, factors such as room temperature and humidity can have an effect on the performance of the ion source.

Furthermore, airborne compounds present in the ambient environment may interact with the ion source and may ionise, resulting in the generation of mass spectral peaks that are not from the sample under analysis. These peaks can change over time, and may be in the same mass range as analyte ions of interest. In addition, many ambient ionisation techniques have safety implications, e.g. due to potentially harmful aspects of the ion source (e.g. solvent, laser beams, etc.) or of the sample, being present in the atmosphere or otherwise accessible to a user.

U.S. Pat. No. 7,847,244 (Venter et al.) discloses an arrangement in which the spray, the sample surface, and the mass spectrometer inlet capillary of a desorption electrospray ionisation ion source are enclosed in a pressure tight enclosure. This arrangement isolates the ion source from the ambient environment.

However, this arrangement can suffer from memory effects wherein analyte ions are trapped within the enclosure for some time before being drawn into the mass spectrometer and analysed. Equally, since in this arrangement the inlet capillary effectively samples the analyte enriched atmosphere of the enclosure, rather than the charged droplets reflected off the sample surface, it is not possible to obtain spatially resolved information.

It is desired to provide an improved ambient ionisation ion source.

SUMMARY

According to an aspect, there is provided an ambient ionisation ion source comprising:

a first device arranged and adapted to generate analyte ions from a target;

an enclosure surrounding the first device, wherein the enclosure includes one or more gas inlets and one or more gas outlets; and a second device arranged and adapted to supply the enclosure with a first gas via the one or more gas inlets such that the enclosure is maintained, in use, at a pressure greater than atmospheric pressure.

The various embodiments described herein are directed to an ambient ionisation ion source comprising a first device arranged and adapted to generate analyte ions from a target, and an enclosure enclosing the first device. The enclosure includes one or more gas inlets and one or more gas outlets. A second device supplies the enclosure with a first gas via the one or more gas inlets such that the enclosure is maintained at a pressure greater than atmospheric pressure and/or greater than the pressure of the ambient (external) environment.

According to various embodiments, the addition of the first gas into the enclosure, e.g. at a slight positive pressure relative to the ambient (external) environment, acts to purge the enclosure, thereby enabling a stable environment for ambient ionisation to be performed. The positive pressure also acts to prevent contaminants from the external environment entering the enclosure and interfering with or otherwise affecting the ionisation process.

In contrast with U.S. Pat. No. 7,847,244 (Venter et al.), the arrangement according to various embodiments does not suffer from memory effects, and allows acquisition of spatially resolved information, e.g. for ion imaging.

In addition, the arrangement according to various embodiments is beneficial in terms of safety, since potentially harmful aspects of the ion source (e.g. solvent, laser beam(s), etc.) and/or of the sample, may be isolated from the ambient environment (e.g. laboratory) and inaccessible to (or at least less accessible to) a user (in normal use).

It will be appreciated therefore that various embodiments provide an improved ambient ionisation ion source.

The ion source may be arranged and adapted such that, in use, at least some of the first gas leaves the enclosure via the one or more gas outlets.

The ion source may be arranged and adapted such that, in use, at least some of the first gas leaves the enclosure via the one or more gas outlets directly to the ambient (e.g. external) environment.

The one or more gas outlets may comprise one or more apertures in the enclosure.

The second device may be arranged and adapted to substantially continuously supply the enclosure with the first gas via the one or more gas inlets.

The ion source may be arranged and adapted such that, in use, at least some of the first gas substantially continuously leaves the enclosure via the one or more gas outlets.

The second device may be arranged and adapted to supply the enclosure with the first gas at a flow rate selected from the group consisting of: (i) <0.1 l/min; (ii) 0.1-0.2 l/min; (iii)

0.2-0.5 l/min; (iv) 0.5-1 l/min; (v) 1-2 l/min; (vi) 2-5 l/min; (vii) 5-10 l/min; and (viii) >10 l/min.

The second device may be arranged and adapted to supply the enclosure with the first gas such that the enclosure is maintained, in use, at a pressure selected from the group consisting of: (i) 100-110 kPa; (ii) 110-120 kPa; (iii) 120-130 kPa; (iv) 130-140 kPa; (v) 140-150 kPa; and (vi) >150 kPa.

The first gas may be inert.

The first gas may comprise nitrogen, air, filtered air, argon and/or carbon dioxide.

The enclosure may comprise one or more first apertures configured to allow access to the first device and/or configured to receive one or more devices for controlling or adjusting the first device (e.g. one or more adjustment rods).

One or more of the one or more first apertures may be or may be used as one or more of the one or more gas outlets.

The ion source may comprise one or more devices arranged and adapted to control the temperature and/or humidity of the first gas and/or the enclosure.

The one or more devices may be arranged and adapted, in use, to maintain the temperature and/or humidity of the first gas and/or the enclosure at a constant value.

The first device may be arranged and adapted to direct a spray of droplets onto the target in order to generate the analyte ions.

The first device may be arranged and adapted to direct a spray of charged droplets onto the target in order to generate the analyte ions.

The first device may comprise: (i) a desorption electrospray ionisation ("DESI") ion source; (ii) a desorption electro-flow focusing ("DEFFI") ion source; (iii) a laser ablation electrospray ("LAESI") ion source; (iv) a direct analysis in real time ("DART") ion source; (v) an atmospheric matrix-assisted laser desorption ionisation ("MALDI") ion source; (vi) a rapid evaporative ionisation mass spectrometry ("REIMS") ion source; (vii) a plasma assisted desorption ionisation ("PADI") ion source; (viii) a low temperature plasma ("LTP") ion source; or (ix) a plasma assisted laser desorption ionisation ("PALDI") ion source.

The first device may be arranged and adapted to generate analyte ions from plural different positions on the target.

According to an aspect there is provided a mass and/or ion mobility spectrometer comprising an ion source as described above.

The mass and/or ion mobility spectrometer may comprise a capillary or other inlet arranged and adapted to transfer the analyte ions into the mass and/or ion mobility spectrometer.

The capillary or other inlet may be arranged and adapted to sample only droplets and/or analyte reflected or ejected (e.g. sprayed) directly from the target.

The capillary or other inlet may be arranged and adapted to sample only charged droplets and/or analyte ions reflected or ejected (e.g. sprayed) directly from the target.

The mass and/or ion mobility spectrometer may comprise a mass and/or ion mobility analyser arranged and adapted to analyse the analyte ions.

The mass and/or ion mobility spectrometer may be arranged and adapted to generate an image, ion image or mass spectrometry image of the target.

According to an aspect there is provided apparatus for imaging, ion imaging or mass spectrometry imaging comprising an ion source as described above.

According to an aspect there is provided apparatus for imaging, ion imaging or mass spectrometry imaging comprising:

an ambient ionisation ion source comprising a first device arranged and adapted to generate analyte ions from a target, an enclosure surrounding the first device, wherein the enclosure includes one or more gas inlets and one or more gas outlets, and a second device arranged and adapted to supply the enclosure with a first gas via the one or more gas inlets such that the enclosure is maintained, in use, at a pressure greater than atmospheric pressure; and an analyser arranged and adapted to analyse the analyte ions so as to generate an image, ion image or mass spectrometry image of the target.

According to an aspect there is provided a method of ambient ionisation comprising:

using a first device to generate analyte ions from a target, wherein the first device is surrounded by an enclosure, and wherein the enclosure includes one or more gas inlets and one or more gas outlets; and supplying the enclosure with a first gas via the one or more gas inlets such that the enclosure is maintained at a pressure greater than atmospheric pressure and/or the pressure of the ambient (e.g. external) environment.

The method may comprise supplying the enclosure with the first gas such that at least some of the first gas leaves the enclosure via the one or more gas outlets.

The method may comprise supplying the enclosure with the first gas such that at least some of the first gas leaves the enclosure via the one or more gas outlets directly to the ambient (e.g. external) environment.

The one or more gas outlets may comprise one or more apertures in the enclosure.

The method may comprise substantially continuously supplying the enclosure with the first gas via the one or more gas inlets.

The method may comprise supplying the enclosure with the first gas such that at least some of the first gas substantially continuously leaves the enclosure via the one or more gas outlets.

The method may comprise supplying the enclosure with the first gas at a flow rate selected from the group consisting of: (i) <0.1 l/min; (ii) 0.1-0.2 l/min; (iii) 0.2-0.5 l/min; (iv) 0.5-1 l/min; (v) 1-2 l/min; (vi) 2-5 l/min; (vii) 5-10 l/min; and (viii) >10 l/min.

The method may comprise supplying the enclosure with the first gas such that the enclosure is maintained at a pressure selected from the group consisting of: (i) 100-110 kPa; (ii) 110-120 kPa; (iii) 120-130 kPa; (iv) 130-140 kPa; (v) 140-150 kPa; and (vi) >150 kPa.

The first gas may be inert.

The first gas may comprise nitrogen, air, filtered air, argon and/or carbon dioxide.

The method may comprise accessing the first device and/or controlling or adjusting the first device through one or more first apertures in the enclosure.

One or more of the one or more first apertures may be or may be used as one or more of the one or more gas outlets.

The method may comprise controlling the temperature and/or humidity of the first gas and/or the enclosure.

The method may comprise maintaining the temperature and/or humidity of the first gas and/or the enclosure at a constant value.

The method may comprise directing a spray of droplets onto the target in order to generate the analyte ions.

The method may comprise directing a spray of charged droplets onto the target in order to generate the analyte ions.

The first device may comprise: (i) a desorption electrospray ionisation ("DESI") ion source; (ii) a desorption electro-flow focusing ("DEFFI") ion source; (iii) a laser ablation electrospray ("LAESI") ion source; (iv) a direct analysis in real time ("DART") ion source; (v) an atmospheric matrix-assisted laser desorption ionisation ("MALDI") ion source; (vi) a rapid evaporative ionisation mass spectrometry ("REIMS") ion source; (vii) a plasma assisted desorption ionisation ("PADI") ion source; (viii) a low temperature plasma ("LTP") ion source; or (ix) a plasma assisted laser desorption ionisation ("PALDI") ion source.

The method may comprise generating analyte ions from plural different positions on the target.

According to an aspect there is provided a method of mass and/or ion mobility spectrometry comprising a method of ambient ionisation as described above.

The method may comprise transferring the analyte ions into a mass and/or ion mobility spectrometer via a capillary or other inlet.

The method may comprise sampling only analyte and/or droplets reflected or ejected (e.g. sprayed) directly from the target using said capillary or other inlet.

The method may comprise sampling only analyte ions and/or charged droplets reflected or ejected (e.g. sprayed) directly from the target using said capillary or other inlet.

The method may comprise mass and/or ion mobility analysing the analyte ions.

The method may comprise generating an image, ion image or mass spectrometry image of the target.

According to an aspect there is a method of imaging, ion imaging or mass spectrometry imaging comprising a method of ambient ionisation as described above.

According to an aspect there is provided a method of imaging, ion imaging or mass spectrometry imaging comprising:

using a first device to generate analyte ions from a target, wherein the first device is surrounded by an enclosure, and wherein the enclosure includes one or more gas inlets and one or more gas outlets;

supplying the enclosure with a first gas via the one or more gas inlets such that the enclosure is maintained at a pressure greater than atmospheric pressure; and analysing the analyte ions so as to generate an image, ion image or mass spectrometry image of the target.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Various embodiments are directed to methods of and apparatus for ambient ionisation mass spectrometry. Ambient ionisation mass spectrometry may be employed for direct analysis of a sample surface. A sample may be analysed under ambient conditions, i.e. not under vacuum. A sample may be analysed in its native state with minimal or no prior sample preparation.

For example, desorption electrospray ionisation ("DESI") allows direct and fast analysis of surfaces without the explicit need for prior sample preparation. The technique will now be described in more detail with reference to FIG. 1.

Figure 1:
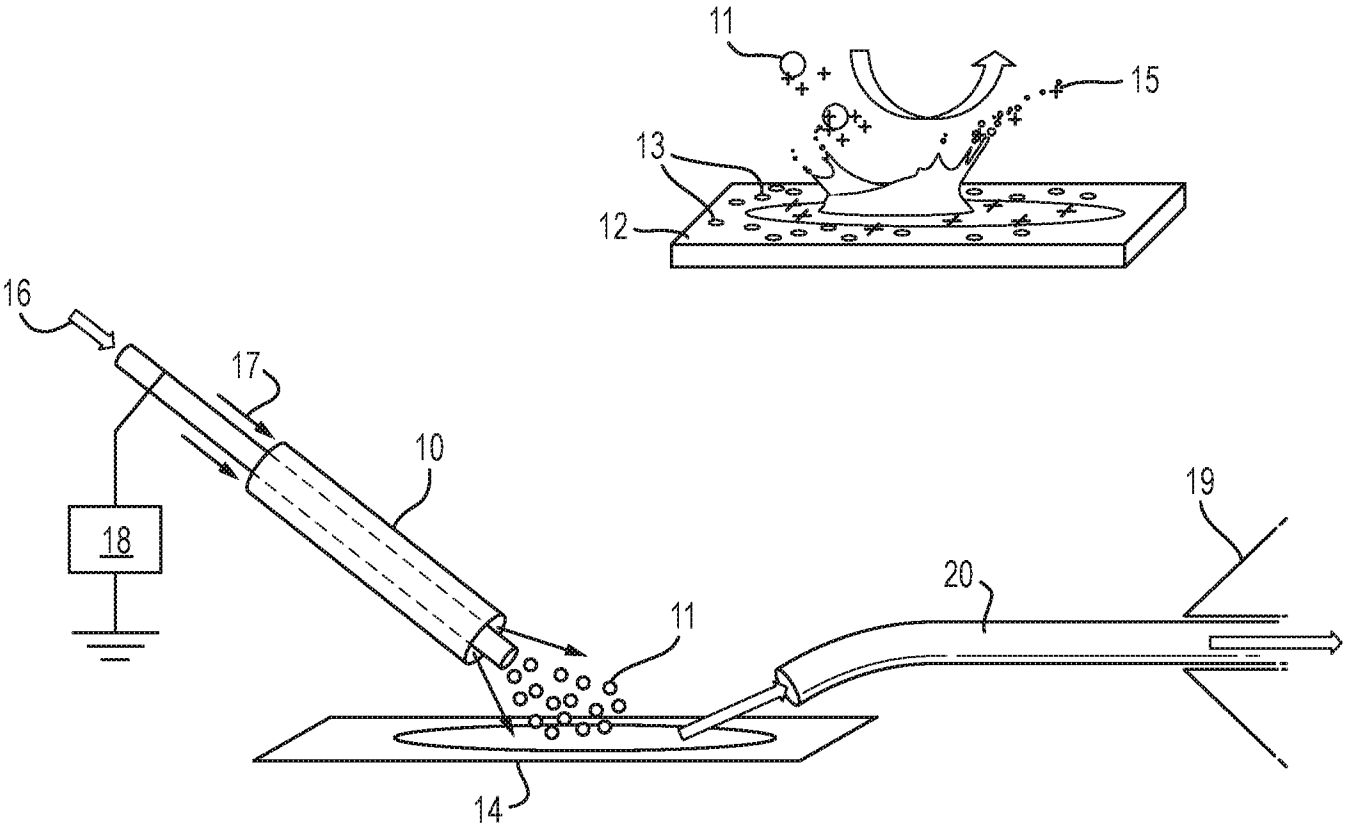
FIG. 1 illustrates schematically the desorption electrospray ionisation technique.

As shown in FIG. 1, the desorption electrospray ionisation ("DESI") technique is an ambient ionisation method that involves directing a spray of (primary) electrically charged droplets 11 onto a surface 12 with analyte 13 present on the surface 12 and/or directly onto a surface of a sample 14. The electrospray mist is pneumatically directed at the sample by a sprayer 10 where subsequent ejected (e.g. splashed) (secondary) droplets 15 carry desorbed ionised analytes (e.g. desorbed lipid ions).

The sprayer 10 may be supplied with a solvent 16, nebulising gas 17 such as nitrogen, and voltage from a high voltage ("HV") source 18. The voltage may be supplied directly (e.g. using a wired connection) or remotely (e.g. using a wireless connection) to the sprayer 10. The solvent 16 may be supplied to a central capillary of the sprayer 10, and the nebulising gas 17 may be supplied to a second capillary that may (at least partially) coaxially surround the central capillary. The arrangement of the capillaries, the flow rate of the solvent 16 and/or the flow rate of the gas 17 may be configured such that solvent droplets are ejected from the sprayer 10. The high voltage may be applied to the central capillary, e.g. such that at least some of the ejected solvent droplets 11 are charged.

According to various other embodiments, the (central capillary of the) sprayer 10 is not (is other than) supplied with a voltage.

The charged (and/or uncharged) droplets 11 are directed at the sample such that subsequent ejected (secondary) droplets 15 carry desorbed analyte ions. The ions travel through air into an atmospheric pressure interface 19 of a mass spectrometer or mass analyser (not shown), e.g. via a transfer capillary 20.

The desorption electrospray ionisation ("DESI") technique allows for ambient ionisation of a trace sample at atmospheric pressure with little sample preparation. The desorption electrospray ionisation ("DESI") technique allows, for example, direct analysis of biological compounds such as lipids, metabolites and peptides in their native state without requiring any advance sample preparation.

A known desorption electrospray ionisation ("DESI") ion source is encased in a protective enclosure to prevent accidental contact with exposed high voltages. However, the cover is loose fitting, resulting in the air inside the chamber having the same composition as the air in the ambient (external) environment, e.g. laboratory.

The ionisation process in desorption electrospray ionisation ("DESI"), and other ambient ionisation techniques, occurs in the ambient atmosphere. Factors such as room temperature and humidity can have an effect on the performance of the ion source, such as the spray emitter 10 causing changes to the desorption and/or ionisation process.

Furthermore, airborne compounds present in the ambient environment may interact with the ion source or spray 11 and may be ionised, resulting in the generation of mass and/or ion mobility spectral peaks that are not from the sample under analysis. These peaks may change over time, and may be in the same mass range as analytes of interest.

In addition, many ambient ionisation techniques have safety implications, e.g. due to potentially harmful aspects of the ion source (e.g. solvent, laser beams, etc.) and/or of the sample, being present in the atmosphere or otherwise accessible to a user.

Various embodiments described herein are directed to an ambient ionisation ion source that comprises a device, such as a desorption electrospray ionisation ("DESI") ion source, for generating analyte ions from a target or sample. The device is surrounded by (e.g. enclosed within) an environmental enclosure, wherein the enclosure includes one or more gas inlets and one or more gas outlets. The enclosure is supplied with a gas, such as nitrogen, via the one or more gas inlets such that the enclosure is maintained at a pressure greater than atmospheric pressure and/or greater than the pressure of the ambient (external) environment.

The ion source may further comprise a sample or target holder, which may comprise a movable sample or target stage. The enclosure may surround (e.g. enclose) the sample or target and the sample or target holder.

The ion source may be part of a mass and/or ion mobility spectrometer, and the mass and/or ion mobility spectrometer may comprise a capillary or other inlet for transferring analyte ions into the mass and/or ion mobility spectrometer. This inlet may or may not be heated. The enclosure may surround (e.g. enclose) the capillary or other inlet, or at least the entrance to the capillary or other inlet.

Accordingly, the enclosure is beneficially arranged to minimise environmental contaminants that can enter the mass and/or ion mobility spectrometer analyser, and to stabilise the ionisation environment.

Various embodiments described herein provided an improved ambient ionisation ion source housing or enclosure, such as a desorption electrospray ionisation ("DESI") ion source housing or enclosure, which is largely sealed, except for one or more gas outlet holes in the enclosure. One or more access holes in the cover, e.g. for inserting adjuster rods, may be used as the gas outlet(s).

A clean nitrogen gas feed may be included into the ion source housing to maintain a stable atmosphere, to improve the stability of the ionisation source, and to minimise contaminants from the environment entering the mass and/or ion mobility spectrometer analyser.

The addition of a gas line into the sample enclosure introducing clean nitrogen at a slight positive pressure (i.e. at a pressure greater than atmospheric pressure and/or greater than the pressure of the ambient (external) environment) acts to purge the chamber, enabling a stable environment for desorption electrospray ionisation ("DESI") to be performed. The positive pressure acts to reduce contaminants from the environment entering the chamber and impinging on the incident spray and the desorbed droplets.

Unlike in the case of U.S. Pat. No. 7,847,244 (Venter et al.), which discloses a sealed pressure tight enclosure, the enclosure according to various embodiments is not fully sealed or gas tight. The majority of the enclosure may be closed, but one or more gas outlets (e.g. one or more small holes for inserting alignment adjuster rods) are provided, with the clean gas entering the chamber escaping through these outlets (holes), e.g. to thereby provide a curtain gas. This prevents any atmospheric contaminants entering the chamber.

The ion source according to various embodiments may be used in methods of ion imaging. In this case, the ion source may generate analyte ions from plural different positions on the target or sample, and then the analyte ions from each position may be analysed. The results of the analysis in respect of multiple positions on the target or sample surface may be combined to generate an ion image or ion map of the target or sample surface. For example, the ion source may be scanned (e.g. in a raster pattern) across the surface of the target or sample and/or the sample may be scanned (e.g. in a raster pattern) relative to the ion source, e.g. by moving the sample or target stage, and then the analyte ions may be analysed in order to generate an ion image or ion map of the target or sample.

It should be understood that as used herein, the terms "image", "imaging" or similar relate to any type of spatial profiling of a sample surface, i.e. where spatially resolved data is acquired for a sample surface (and that, for example, in these embodiments, an "image" need not be displayed or otherwise formed).

U.S. Pat. No. 7,847,244 (Venter et al.) teaches the addition of multiple sprayers to increase the concentration of the sample in the enclosed atmosphere. In U.S. Pat. No. 7,847,244 (Venter et al.), the sampling orifice does not sample the charged droplets reflected off the sample surface, but instead samples the sample enriched atmosphere of the sample chamber. This prohibits the acquisition of spatially resolved information, and means that the ion source described in U.S. Pat. No. 7,847,244 (Venter et al.) cannot be used for mass spectrometry ("MS") imaging.

Figure 2:
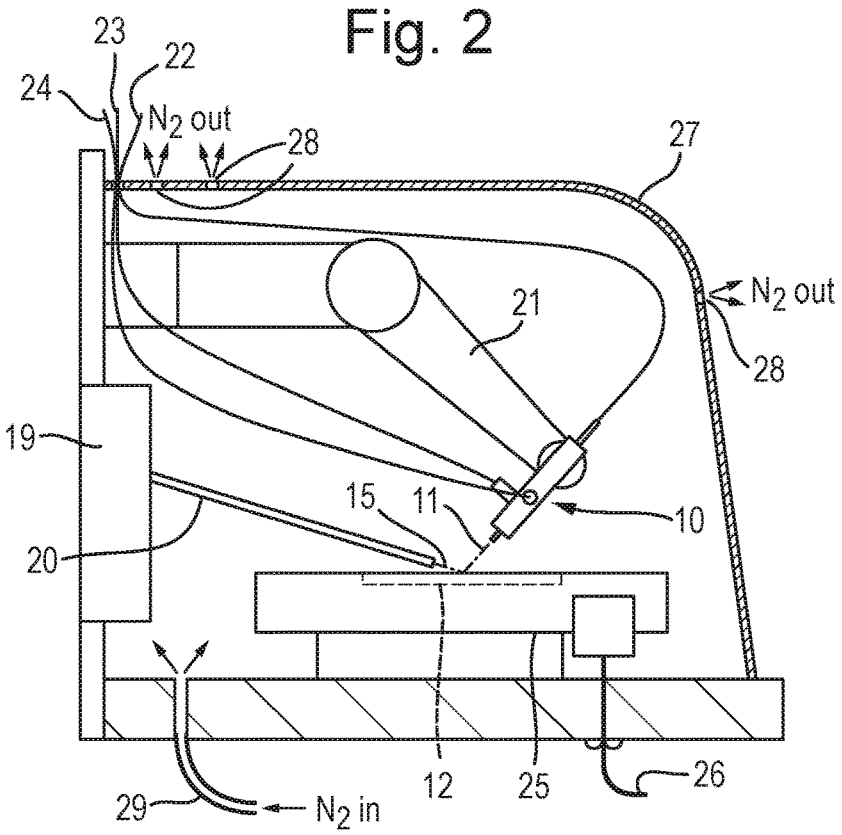
FIG. 2 shows schematically a desorption electrospray ionisation ion source in accordance with an embodiment.

FIG. 2 shows a desorption electrospray ionisation ion source in accordance with an embodiment. As shown in FIG. 2, the ion source comprises a desorption electrospray ionisation ("DESI") sprayer 10. The sprayer 10 is mounted on an arm 21 which may be used to control the position and/or orientation of the sprayer 10. The arm 21 may be controlled manually, e.g. by one or more adjuster rods (not shown), and/or robotically.

The sprayer 10 is provided with a solvent, e.g. via solvent capillary 22, a nebuliser gas, e.g. via nebuliser gas feed 23, and a voltage, e.g. via capillary high voltage feed 24. The voltage could alternatively be supplied remotely (e.g. using a wireless connection). The solvent may be supplied to a central capillary of the sprayer 10, and the nebulising gas may be supplied to a second capillary that may (at least partially) coaxially surround the central capillary. The arrangement of the capillaries, the flow rate of the solvent and/or the flow rate of the gas may be configured such that solvent droplets are ejected from the sprayer 10. The high voltage may be applied to the central capillary, e.g. such that at least some of the ejected solvent droplets 11 are charged.

The sprayer 10 is configured to direct the spray of charged droplets 11 onto the surface of a sample. The sprayer 10 could additionally or alternatively be configured to direct a spray of uncharged droplets 11 onto the surface of the sample. In this case, the sprayer 10 may not be (is other than) supplied with a voltage. Subsequent ejected (e.g. splashed) (secondary) droplets 15 carry desorbed ionised analytes which are sampled by an atmospheric pressure interface 19 of a mass and/or ion mobility spectrometer or analyser via a transfer capillary 20.

The capillary 20 (or another inlet) may be arranged and adapted to transfer the analyte ions into the mass and/or ion mobility spectrometer, wherein a mass and/or ion mobility analyser may analyse the analyte ions. The capillary 20 may or may not be heated.

As shown in FIG. 2, the sample may be provided on a sample slide 12, and the sample slide 12 may be provided on a moveable sample stage (x-y sample stage) 25. The sample slide 12 may be loaded onto the sample stage 25 manually or automatically, e.g. using an automatic slide loader or similar. A motor cable 26 is connected to the sample stage 25. The motor cable 26 may be provided to the enclosure 27 via a gas tight port or fitting. The sample stage may be moved, e.g. such that the spray of (charged) droplets 11 is directed towards different positions of the sample surface.

An ion image or ion map may be formed by scanning the position of the sample stage 25 (and therefore the position of the sample or target) relative to the sprayer 10 (e.g. in a raster pattern) (and/or by scanning the position of the sprayer 10 across the surface of the target or sample), and analysing analyte ions ejected from multiple different positions on the surface of the sample or target.

The ion source may be configured such that the capillary 20 (or other analyser inlet) only samples (charged) droplets and/or analyte (ions) that are directly reflected or ejected (e.g. sprayed) from the sample or target. This facilitates the production of an ion image or ion map of the sample surface, and is in contrast to U.S. Pat. No. 7,847,244 (Venter et al.), in which the analyte enriched atmosphere of the sample chamber is sampled.

As shown in FIG. 2, the sprayer 10, arm 21, sample slide 12, sample stage 25, and the capillary 20 are all surrounded by (e.g. enclosed within) an enclosure or cover 27. The enclosure 27 is not gas tight, but rather is provided with one or more gas outlets 28 in the form of one or more access holes for the adjuster rods.

A gas inlet 29 is also provided, such that the enclosure 27 may be filled with a gas, such as nitrogen. Gas may be continuously provided to the enclosure 27 via the inlet 29, and may be continuously exhausted to the ambient environment via the one or more outlets 28, i.e. such that a continuous flow of gas passes though the enclosure 27. The flow rate of the gas and/or the size or number of outlets 28 may be selected such that a slight positive pressure is maintained within the enclosure 27. The gas inlet 29 may be configured such that in (normal) use, the gas inlet 29 is provided beneath the gas outlets 28.

As such, the enclosure 27 is provided with a nitrogen bath, which acts to purge the environment surrounding the ion source, sample and inlet capillary 20. This provides a controlled, reproducible atmosphere such that the output from the sprayer 10, the desorption process, and the collection of ions by the capillary 20 is consistent during an experiment or acquisition, and from one experiment or acquisition to another, despite any changes in the external conditions. This approach also prevents potential contaminants entering the mass and/or ion mobility spectrometer from the external environment, and is beneficial in terms of user safety (as described above).

The ion source is arranged such that analyte ions generated by interaction with the spray of (charged) droplets 11 are substantially instantaneously sampled into the capillary 20 for analysis by the mass and/or ion mobility spectrometer. Any (charged) droplets and/or ions that are not substantially instantaneously sampled into the capillary 20 are removed by the gas (nitrogen) flow. Accordingly, the arrangement does not suffer from memory effects, i.e. wherein analyte ions are trapped within the enclosure for some time before being drawn into the mass and/or ion mobility spectrometer and analysed. The capillary 20 only samples (charged) droplets and/or analyte ions 15 that are directly reflected or ejected (e.g. sprayed) from the target or sample, and does not sample other (charged) droplets and/or analyte ions in the enclosure environment.

This accordingly means that the arrangement according to various embodiments can be beneficially used to perform ion imaging of the target or sample. In this case, by scanning the sample stage 25, e.g. in a raster line pattern, and mass and/or ion mobility analysing the resulting analyte ions from multiple different positions of the sample surface, an ion image of the sample can be produced.

Figure 3:
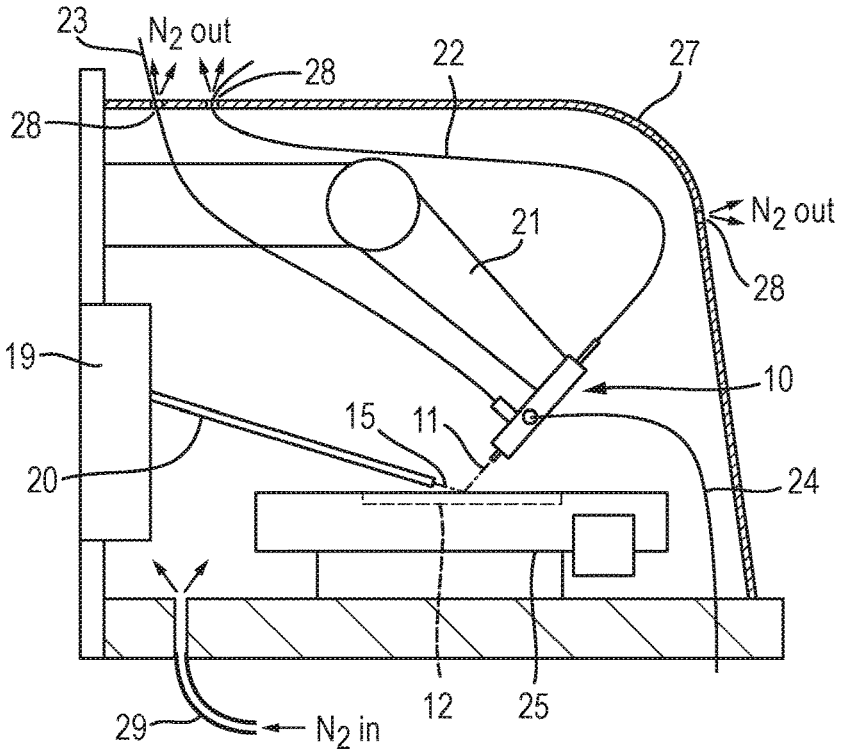
FIG. 3 shows schematically a desorption electrospray ionisation ion source in accordance with an embodiment.

FIG. 3 shows a desorption electrospray ionisation ion source in accordance with another embodiment. The ion source of FIG. 3 is substantially similar to the ion source of FIG. 2.

However, in FIG. 3, the solvent capillary 22, and the nebuliser gas feed 23 are provided to the enclosure 27 via one or more of the one or more gas outlets/access holes 28. As also shown in FIG. 3, the capillary high voltage feed 24 (where present) may be provided to the enclosure 27 via a (dedicated) gas tight port or fitting.

This is in contrast with the arrangement of FIG. 2, in which the solvent capillary 22, the nebuliser gas feed 23, and the capillary high voltage feed 24 are all provided to the enclosure 27 via a (dedicated) gas tight port or fitting.

As also shown in FIG. 3, the motor cable 26 may be omitted from the ion source, and, e.g. a battery used in its place. This reduces the number of openings in the enclosure 27.

In general any one of more or all of the solvent capillary 22, the nebuliser gas feed 23, the capillary high voltage feed 24 and the motor cable 26 (where present) may be provided to the enclosure 27 via one or more of the one or more gas outlets/access holes 28, and/or via one or more (dedicated) gas tight ports or fittings.

According to various embodiments, one or more or all of the one or more inlets 29 and/or one or more or all of the one or more gas outlets 28 may be provided with a device configured to close the inlet or outlet, i.e. to seal the inlet or outlet in respect of gas. In particular, one or more or each of the one or more gas outlets/access holes 28 may be provided with a self-sealing fitting, e.g. which may be configured to close when the adjustment rod(s) or tool(s) is removed. This is particularly beneficial, e.g., where the analyte, fumes and/or solvent, etc., being used present a hazard to the user.

In general any one or more or all of the gas outlet 28 may exhaust directly to the ambient (external) environment or may exhaust to an extraction pump.

According to various embodiments, one or more of the one or more gas outlets 28 may be filtered. That is, the enclosure 27 may be provided with one or more filtered exhaust ports. The or each filtered exhaust port may either separate the sample chamber 27 from the surrounding (external) atmosphere, or may be connected to an extraction pump. This can provide benefits in terms of safety to a user, and can facilitate the maintenance of a stable environment within the sample analysis chamber 27.

According to various further embodiments, the enclosure 27 and/or the environmental bath gas may be temperature controlled, e.g. to stabilise the enclosed environment and/or to optimise the ionisation efficiency of ion source (e.g. of the desorption electrospray ionisation ("DESI") sprayer 10).

The temperature may be maintained at a substantially constant temperature value, i.e. at a selected temperature or within a selected temperature range, e.g. during one or more particular experiments or acquisitions. For example, the temperature may be maintained at a substantially constant temperature value during the generation of an (entire) ion image or ion map. This ensures that the ion image or ion map is accurate and consistent.

The temperature or temperature range may be selected on the basis of the particular sample or sample type being analysed (e.g. where it is known that a particular temperature or temperature range is beneficial in respect of the particular sample or sample type) and/or the desired (e.g. optimum) ionisation conditions.

A device (e.g. thermometer) for measuring the temperature, such as a thermocouple or similar device, may be provided, e.g. within the enclosure 27. This may be used to allow feedback control of the temperature. That is, a particular (optimum) temperature or temperature range may be selected, e.g. on the basis of the sample being analysed and/or the desired (e.g. optimum) ionisation conditions, and the temperature of the gas and/or the temperature within the enclosure 27 may be monitored. If (when) it is determined that the temperature is not at or is not sufficiently close to the selected temperature or temperature range, then the temperature of the enclosure 27 and/or the environmental bath gas may be appropriately altered.

In this regard, one or more heaters may be provided, e.g. to heat the enclosure 27 and/or the environmental bath gas (where necessary) and/or one or more cooling or refrigeration devices may be provided, e.g. to cool the enclosure and/or the environmental bath gas (where necessary). For example, a cooling or refrigeration technique may be applied to the inlet of the bath gas, e.g. in order to stabilise the temperature of the atmosphere within the chamber.

Additionally or alternatively, the environmental bath gas may be humidity controlled, e.g. to stabilise the enclosed environment or optimise the ionisation efficiency of the ion source (e.g. of the desorption electrospray ionisation ("DESI") sprayer 10).

The humidity may be maintained at a substantially constant humidity value, i.e. at a selected humidity value or within a selected humidity range, e.g. during one or more particular experiments or acquisitions. For example, the humidity may be maintained at a substantially constant humidity value during the generation of an (entire) ion image or ion map. This ensures that the ion image or ion map is accurate and consistent.

The humidity or humidity range may be selected on the basis of the particular sample or sample type being analysed (e.g. where it is known that a particular humidity or humidity range is beneficial in respect of the particular sample or sample type) and/or the desired (e.g. optimum) ionisation conditions.

A humidity monitor, such as a capacitive hygrometer, may be provided, e.g. within the enclosure 27. This may be used to allow feedback control of the humidity. That is, a particular (optimum) humidity or humidity range may be selected, e.g. on the basis of the sample being analysed and/or the desired (e.g. optimum) ionisation conditions, and the humidity of the gas and/or the humidity within the enclosure 27 may be monitored. If (when) it is determined that the humidity is not at or is not sufficiently close to the selected humidity or humidity range, then the humidity of the enclosure 27 and/or the environmental bath gas may be appropriately altered.

In this regard, one or more humidity controllers may be provided, e.g. to control the humidity within the enclosure 27 and/or of the environmental bath gas (where necessary). For example, a humidity controller may be provided in the inlet gas feed, and this may be used to regulate the ambient humidity within the sample chamber 27.

The bath gas may comprise any suitable (clean) gas, such as nitrogen, filtered air, argon, carbon dioxide ($CO_2$), etc.

According to various embodiments, the flow rate of the gas may range from zero (null) to several litres per minute. For example, the flow rate may be selected from the group consisting of: (i) <0.1 l/min; (ii) 0.1-0.2 l/min; (iii) 0.2-0.5 l/min; (iv) 0.5-1 l/min; (v) 1-2 l/min; (vi) 2-5 l/min; (vii) 5-10 l/min; and (viii) >10 l/min. This may cause the enclosure 27 to be maintained, in use, at a pressure selected from the group consisting of: (i) 100-110 kPa; (ii) 110-120 kPa; (iii) 120-130 kPa; (iv) 130-140 kPa; (v) 140-150 kPa; and (vi) >150 kPa.

Although the above embodiments have been described primary in terms of the desorption electrospray ionisation ("DESI") technique, the approach according to various embodiments may also be used for other ambient ionisation techniques, such as direct analysis in real time ("DART") ionisation, atmospheric matrix-assisted laser desorption ionisation ("atmospheric MALDI"), desorption electro-flow focusing ionisation ("DEFFI"), laser ablation electrospray ("LAESI") ionisation, rapid evaporative ionisation mass spectrometry, plasma assisted desorption ionisation ("PADI") ionisation, low temperature plasma ("LTP") ionisation, and plasma assisted laser desorption ionisation ("PALDI") ionisation.

For example, according to an embodiment the ambient ionisation ion source may comprise a rapid evaporative ionisation mass spectrometry ("REIMS") ion source wherein an RF voltage is applied to electrodes in order to generate an aerosol or plume of surgical smoke by Joule heating.

Figure 4:
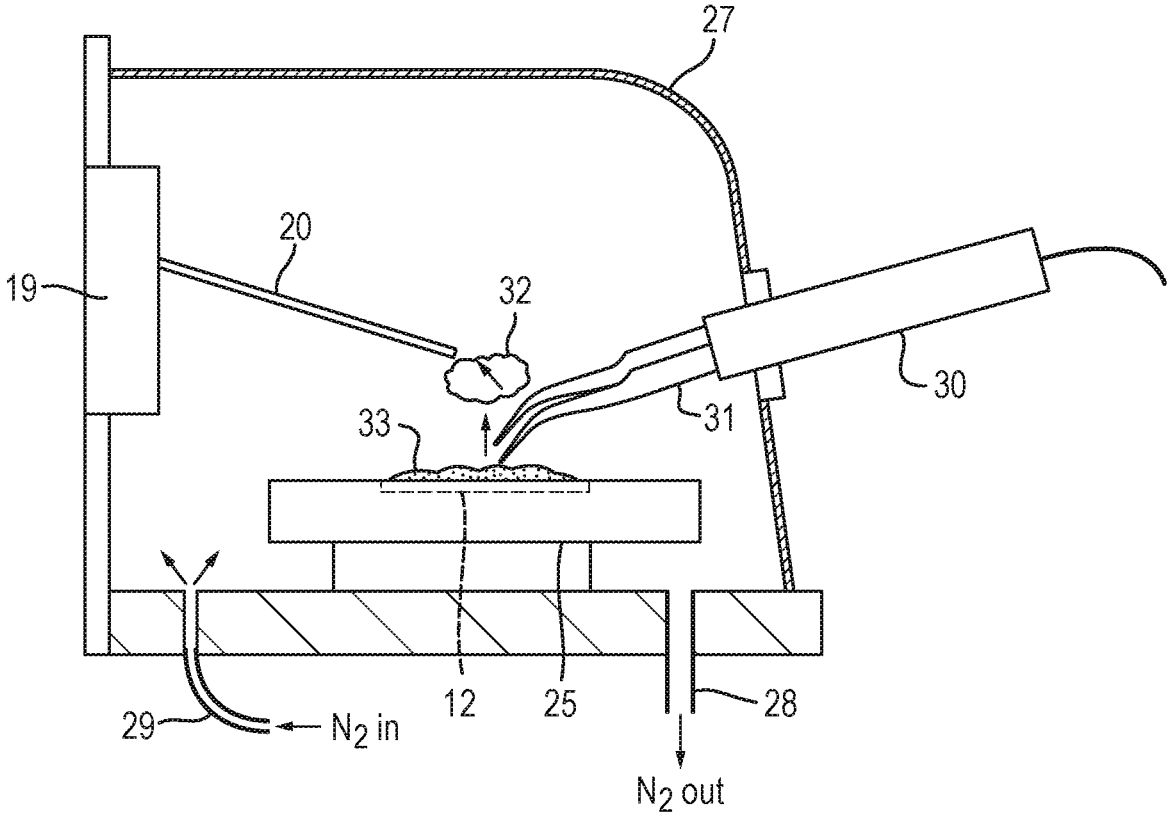
FIG. 4 shows schematically a rapid evaporative ionisation mass spectrometry ("REIMS") ion source in accordance with an embodiment.

FIG. 4 shows a rapid evaporative ionisation mass spectrometry ("REIMS") ion source in accordance with an embodiment. The ion source of FIG. 4 is substantially similar to the ion sources of FIGS. 2 and 3.

However, as shown in FIG. 4, the ion source comprises a rapid evaporative ionisation mass spectrometry ("REIMS") device 30. The device 30 is provided to the enclosure 27 via a gas tight port or fitting. The position and/or orientation of the device 30 may be controlled manually and/or robotically.

The device 30 comprises a pair of electrodes 31, wherein application of an RF voltage to the electrodes 31 can be used to generate an aerosol or plume of smoke 32 by Joule heating of a sample 33.

As shown in FIG. 4, the rapid evaporative ionisation mass spectrometry ("REIMS") device 30 may comprise a pair of bipolar forceps or tweezers. The bipolar forceps may be brought into contact with a sample (e.g. in vitro tissue), and the RF voltage may be applied to the bipolar forceps to cause localised Joule or diathermy heating of the sample (e.g. tissue). However, any suitable rapid evaporative ionisation mass spectrometry ("REIMS") sampling device may be provided and used, such as a surgical diathermy device in place of the bipolar forceps.

The aerosol or smoke 32 may be transferred to a mass and/or ion mobility spectrometer via a capillary 20 (or another inlet), wherein the aerosol or smoke 32 may be (mass) analysed. The capillary 20 may or may not be heated. The ion source may be configured such that the capillary 20 (or other analyser inlet) only samples aerosol or smoke 32 that is directly ejected from the sample or target 33.

In this case (and in various embodiments), one or more dedicated gas outlets 28 may be provided, e.g. where it is unnecessary to provide access holes for adjuster rods.

It will be appreciated that numerous other ambient ion sources including those referred to above may be utilised. In particular, according to various other embodiments, the ambient ionisation ion source may comprise a desorption electro-flow focusing ("DEFFI") ion source, a laser ablation electrospray ("LAESI") ion source, a direct analysis in real time ("DART") ion source, an atmospheric matrix-assisted laser desorption ionisation ("MALDI") ion source, a plasma assisted desorption ionisation ("PADI") ion source, a low temperature plasma ("LTP") ion source, or a plasma assisted laser desorption ionisation ("PALDI") ion source.

Where the ambient ionisation ion source comprises a laser ionisation ion source, the laser ionisation ion source may comprise a mid-IR laser ablation ion source. For example, there are several lasers which emit radiation close to or at 2.94 μm which corresponds with the peak in the water absorption spectrum. According to various embodiments the ambient ionisation ion source may comprise a laser ablation ion source having a wavelength close to 2.94 μm, i.e., on the basis of the high absorption coefficient of water at 2.94 μm. According to an embodiment the laser ablation ion source may comprise an Er:YAG laser which emits radiation at 2.94 μm.

Other embodiments are contemplated wherein a mid-infrared optical parametric oscillator ("OPO") may be used to produce a laser ablation ion source having a longer wavelength than 2.94 μm. For example, an Er:YAG pumped ZGP-OPO may be used to produce laser radiation having a wavelength of e.g. 6.1 μm, 6.45 μm or 6.73 μm. In some situations it may be advantageous to use a laser ablation ion source having a shorter or longer wavelength than 2.94 μm since only the surface layers will be ablated and less thermal damage may result. According to an embodiment a Co:MgF2 laser may be used as a laser ablation ion source wherein the laser may be tuned from 1.75-2.5 μm. According to another embodiment an optical parametric oscillator ("OPO") system pumped by a Nd:YAG laser may be used to produce a laser ablation ion source having a wavelength between 2.9-3.1 μm. According to another embodiment a $CO_2$ laser having a wavelength of 10.6 μm may be used to generate the aerosol, smoke or vapour.

Although the present invention has been described with reference to preferred embodiments, it will be understood by those skilled in the art that various changes in form and detail may be made without departing from the scope of the invention as set forth in the accompanying claims.

The invention claimed is:

1. An ambient ionisation ion source comprising:

a sample or target holder;

a capillary or other inlet;

a sprayer arranged and adapted to generate analyte ions from a sample or target on said sample or target holder, wherein said sprayer is arranged and adapted to direct a spray of droplets onto said sample or target in order to generate said analyte ions, wherein said ion source is configured such that at least some of said analyte ions are sampled into said capillary or other inlet, and wherein said sprayer comprises: (i) a desorption electrospray ionisation ("DESI") sprayer; or (ii) a desorption electro-flow focusing ("DEFFI") sprayer;

an enclosure surrounding said sample or target holder, said sample or target, said sprayer, and said capillary or other inlet, wherein said enclosure includes one or more gas inlets and one or more gas outlets; and a gas feed arranged and adapted to supply said enclosure with a first gas via said one or more gas inlets such that said enclosure is maintained, in use, at a pressure greater than atmospheric pressure so as to purge said enclosure, wherein said first gas is inert, wherein said gas feed is arranged and adapted to substantially continuously supply said enclosure with said first gas via said one or more gas inlets, wherein said ion source is arranged and adapted such that, in use, at least some of said first gas substantially continuously leaves said enclosure via said one or more gas outlets, wherein said gas feed is arranged to fill the enclosure with said first gas, and wherein the ion source is configured such that droplets and analyte ions that are not sampled into said capillary or other inlet are removed from said enclosure by said first gas;

wherein said enclosure comprises one or more first apertures for allowing access to said sprayer and/or for receiving one or more devices for controlling or adjusting said sprayer, and wherein one or more of said one or more first apertures is or are used as one or more of said one or more gas outlets.

2. An ion source as claimed in claim 1, wherein said ion source is arranged and adapted such that, in use, at least some of said first gas leaves said enclosure via said one or more gas outlets directly to the ambient environment.

3. An ion source as claimed in claim 1, wherein said one or more gas outlets comprise one or more apertures in said enclosure.

4. An ion source as claimed in claim 1, wherein said first gas comprises nitrogen.

5. An ion source as claimed in claim 1, comprising one or more devices arranged and adapted to control the temperature and/or humidity of said first gas and/or said enclosure;

wherein said one or more devices are arranged and adapted, in use, to maintain the temperature and/or humidity of said first gas and/or said enclosure at a constant value.

6. An ion source as claimed in claim 1, wherein said sprayer is arranged and adapted to generate analyte ions from plural different positions on said sample or target.

7. A mass and/or ion mobility spectrometer comprising an ion source as claimed in claim 1.

8. A mass and/or ion mobility spectrometer as claimed in claim 7, wherein said capillary or other inlet is arranged and adapted to transfer said analyte ions into said mass and/or ion mobility spectrometer, and wherein said capillary or other inlet is arranged and adapted to sample only droplets and/or analyte directly reflected or ejected from said sample or target.

9. A mass and/or ion mobility spectrometer as claimed in claim 7, wherein said mass and/or ion mobility spectrometer is arranged and adapted to generate an image, ion image or mass spectrometry image of said sample or target.

10. Apparatus for imaging, ion imaging or mass spectrometry imaging comprising:

an ambient ionisation ion source as claimed in claim 1; and an analyser arranged and adapted to analyse said analyte ions so as to generate an image, ion image or mass spectrometry image of said sample or target.

11. A method of ambient ionisation comprising:

using a sprayer to generate analyte ions from a sample or target on a sample or target holder, wherein said sprayer sprays droplets onto said sample or target in order to generate said analyte ions, wherein at least some of said analyte ions are sampled into a capillary or other inlet, wherein said sample or target, said sample or target holder, said sprayer, and said capillary or other inlet is surrounded by an enclosure, wherein said enclosure includes one or more gas inlets and one or more gas outlets, and wherein said sprayer comprises: (i) a desorption electrospray ionisation ("DESI") sprayer; or (ii) a desorption electro-flow focusing ("DEFFI") sprayer; and substantially continuously supplying said enclosure with a first gas via said one or more gas inlets such that said enclosure is maintained at a pressure greater than atmospheric pressure so as to purge said enclosure, wherein said first gas is inert, wherein at least some of said first gas substantially continuously leaves said enclosure via said one or more gas outlets, wherein first gas fills the enclosure, and wherein droplets and analyte ions that are not sampled into said capillary or other inlet are removed from said enclosure by said first gas;

wherein said enclosure comprises one or more first apertures for allowing access to said sprayer and/or for receiving one or more devices for controlling or adjusting said sprayer, and wherein one or more of said one or more first apertures is or are used as one or more of said one or more gas outlets.

12. A method of mass and/or ion mobility spectrometry comprising a method of ambient ionisation as claimed in claim 11.

13. A method of imaging, ion imaging or mass spectrometry imaging comprising:

generating analyte ions from a sample or target using a method of ambient ionisation as claimed in claim 11; and analysing said analyte ions so as to generate an image, ion image or mass spectrometry image of said sample or target.

* * * * *